US008113275B2

(12) United States Patent
McGuire et al.

(10) Patent No.: US 8,113,275 B2
(45) **Date of Patent: *Feb. 14, 2012**

(54) MULTIPART FRAC HEAD WITH REPLACEABLE COMPONENTS

(75) Inventors: Bob McGuire, Moore, OK (US); Danny Lee Artherholt, Asher, OK (US)

(73) Assignee: Stinger Wellhead Protection, Inc., Oklahoma City, OK (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/941,243

(22) Filed: Nov. 8, 2010

(65) Prior Publication Data

US 2011/0048698 A1 Mar. 3, 2011

Related U.S. Application Data

(62) Division of application No. 11/787,575, filed on Apr. 17, 2007, now Pat. No. 7,828,053.

(51) Int. Cl.
*E21B 19/00* (2006.01)

(52) U.S. Cl. ..... 166/177.5; 166/90.1

(58) Field of Classification Search ..... 166/90.1, 166/75.15, 177.5, 379
See application file for complete search history.

(56) References Cited

U.S. PATENT DOCUMENTS

| | | | | |
|---|---|---|---|---|
| 4,284,475 | A | 8/1981 | Anthony | |
| 4,832,128 | A | 5/1989 | Light et al. | |
| 5,975,211 | A | 11/1999 | Harris | |
| 6,712,147 | B2 | 3/2004 | Dallas | |
| 6,899,172 | B2 | 5/2005 | McLeod et al. | |
| 7,204,474 | B2 | 4/2007 | McGuire et al. | |
| 7,213,641 | B2 | 5/2007 | McGuire et al. | |
| 7,789,133 | B2 * | 9/2010 | McGuire | 166/90.1 |
| 2006/0027779 | A1 | 2/2006 | McGuire et al. | |
| 2006/0090891 | A1 | 5/2006 | McGuire et al. | |
| 2006/0091347 | A1 | 5/2006 | McGuire et al. | |
| 2006/0137882 | A1 | 6/2006 | McGuire et al. | |
| 2007/0251578 | A1 | 11/2007 | McGuire | |

* cited by examiner

*Primary Examiner* — David Bagnell
*Assistant Examiner* — Cathleen Hutchins
(74) *Attorney, Agent, or Firm* — Nelson Mullins Riley & Scarborough, LLP

(57) ABSTRACT

A multipart frac head with removable components permits the frac head to be refurbished in the field. A bottom leg and inlet ports of the multipart frac head can be replaced.

14 Claims, 7 Drawing Sheets

MULTIPART FRAC HEAD WITH REPLACEABLE COMPONENTS

RELATED APPLICATIONS

This application is a division of U.S. patent application Ser. No. 11/787,575 filed Apr. 17, 2007.

FIELD OF THE INVENTION

This invention relates in general to hydrocarbon well stimulation equipment and, in particular, to a multipart frac head with components that can be replaced permits the frac head to be refurbished in the field.

BACKGROUND OF THE INVENTION

The exploitation of marginal gas wells has necessitated an increase in the volume of proppant pumped through a frac head and associated wellhead isolation equipment during certain well stimulation operations. More than 10,000,000 pounds (4,500,000 kg) of proppant (e.g., frac sand, sintered bauxite, or ceramic pellets) mixed with a fracturing fluid such as "slick water" may be pumped down a wellbore at rates of up to 300+ bbl/minute during a multi-stage well stimulation procedure. As understood by those skilled in the art, pumping millions of pounds of abrasive proppant through a frac head at those rates causes abrasion, commonly referred to as "wash", even if the frac head is designed to be abrasion resistant.

Frac heads are normally constructed from a frac head body of alloy steel (e.g. 4140 steel) with a central passage that provides a conduit for directing high-pressure fracturing fluids into a frac mandrel. The frac mandrel provides pressure isolation for pressure-sensitive wellhead equipment and conducts the fracturing fluid into a casing or a tubing of a well. Side entries are drilled through the frac head body to communicate with the central bore, and inlet ports are welded into the side entries. The outer ends of the inlet ports provide connection points for "frac irons", which are steel pipes that conduct the high-pressure fracturing fluids from frac pumps to the frac head. Frac heads are generally built with 2-5 inlet ports. Each inlet port must be carefully welded into the frac head body by a skilled welder after the parts are pre-heated to 400°-600° F. to prepare them for welding. The welder builds up layers of weld metal to secure each inlet port. The weld must secure the inlet ports against 10,000-15,000 psi of fluid pressure induced by the frac fluids and violent mechanical forces transferred from the frac irons, which frequently vibrate and oscillate with significant force in response to flow obstructions and/or unbalanced pump loads. After all of the welding is completed the frac head is post-heated to 1100-1150° F. for about an hour/inch of thickness of the thickest part, and controllably cooled to below 300° F. before the welded areas are ground to a finished surface. Alternatively, the grinding may be performed before the post-heating. After complete cooling, paint is applied. All of the skilled labor, time and materials required to build the frac head makes it expensive to construct and to own.

Furthermore, when a frac head becomes worn due to wash, it has to be transported to a specially equipped machine shop to be refurbished. This may require transporting the heavy frac head hundreds or thousands of miles for repair. To refurbish the frac head, the washed surfaces have to be machined down to a consistent internal diameter to prepare them for welding, an operation known as "over boring". If an inlet port or a bottom flange/adapter is too worn, it may have to be completely cut out and replaced with a new component. After machining, the frac head is heated (400°-600° F.) to prepare it for welding before weld metal is built up on the machined surfaces to a required thickness to restore the frac head to original specifications. Once the welding is completed the frac head must be post-heated to 1100-1150° F. for about one hour/inch of thickness of the thickest part for stress relief, and controllably cooled to below 300° F. The frac head is then re-machined to provide a smooth bore to inhibit abrasion. If any defects are discovered after machining, the entire heating, welding and post-heating processes must be repeated. Not only is refurbishing a frac head a time-consuming and expensive operation, the welded repair is never as resistant to abrasion as the original parts. Furthermore, the repaired frac head must be returned to the field, which again entails transportation expense.

In order to reduce the cost of maintaining frac heads, abrasion-resistant frac heads were invented, as taught for example in Applicant's United States Patent application number 2006/0090891A1 published on May 4, 2006. Abrasion resistant frac heads significantly reduce frac head maintenance, but cannot eliminate it. Because abrasion-resistant steels are brittle they cannot be used to line a bottom end of the central passage through the frac head, which is subject to impact and compression forces. Consequently, even abrasion-resistant frac heads require occasional maintenance besides the replacement of abrasion-resistant liners.

There therefore exists a need for a frac head that can be refurbished in the field.

SUMMARY OF THE INVENTION

It is therefore an object of the invention to provide a multipart frac head with removable components that can be refurbished in the field.

The invention therefore provides a multipart frac head, comprising: a frac head body having a plurality of inlet ports threadedly secured in respective side entries in the frac head body, and a bottom leg socket in a bottom end of the frac head body; and a bottom leg removably secured in the bottom leg socket, the bottom leg comprising an inner end having an elongated pin thread that cooperates with the box thread in the bottom leg socket to secure the bottom leg in the bottom leg socket, the elongated pin thread extending beyond the bottom leg socket when the bottom leg is secured in the bottom leg socket and is engaged by a box thread of a lock nut that is tightened against the bottom end of the frac head body to lock the bottom leg in the bottom leg socket, and an outer end that includes an external shoulder with an upper side that supports a threaded union nut and an underside with a metal ring gasket groove.

The invention further provides a multipart frac head, comprising: a frac head body having a plurality of inlet ports threadedly secured in respective side entries machined in a sidewall of the frac head body, and a bottom leg socket in a bottom end of the frac head body that comprises a box thread and a seal bore located inwardly of the box thread; a bottom leg removably secured in the bottom leg socket, the bottom leg comprising an inner end received in the seal bore and an elongated pin thread that cooperates with the box thread to secure the bottom leg in the bottom leg socket; and a lock nut threadedly secured to an outer end of the elongated pin thread, the lock nut being tightened against a bottom end of the frac head body to lock the bottom leg in the bottom leg socket.

The invention yet further provides a multipart frac head, comprising: a frac head body having a plurality of threaded side entries retained in respective inlet ports, and a bottom leg socket that comprises a box thread and a seal bore located inwardly of the box thread; a bottom leg threadedly secured in the bottom leg socket, the bottom leg comprising an inner end received in the seal bore, the inner end cooperating with high-pressure seals in the seal bore to provide a high-pressure fluid seal around the bottom leg, and an elongated pin thread that cooperates with the box thread to secure the bottom leg in the bottom leg socket; a lock nut threadedly secured to an outer end of the elongated pin thread, the lock nut being tightened against a bottom end of the frac head body to lock the bottom leg in the bottom leg socket.

BRIEF DESCRIPTION OF THE DRAWINGS

Having thus generally described the nature of the invention, reference will now be made to the accompanying drawings, in which.

DETAILED DESCRIPTION OF THE PREFERRED EMBODIMENTS

The invention provides a multipart frac head with components that can be replaced to permit the multipart frac head to be refurbished in the field, so that costs associated with maintenance operations are reduced. In one embodiment the multipart frac head has a removable bottom leg. Since most abrasion in a frac head occurs in the bottom leg where converging streams of abrasive frac fluid are most turbulent, the removable bottom leg permits the multipart frac head to be refurbished in the field before it must be returned to a machine shop to be completely overhauled or recycled. In another embodiment the bottom leg and the inlet ports of the multipart frac head are all removable and can be replaced. This permits the multipart frac head to be built using only machined parts. No welding is required. The inlet ports as well as the bottom leg of the multipart frac head can be replaced in the field, reducing construction and maintenance costs and further reducing transportation costs associated with frac head maintenance.

Figure 1:
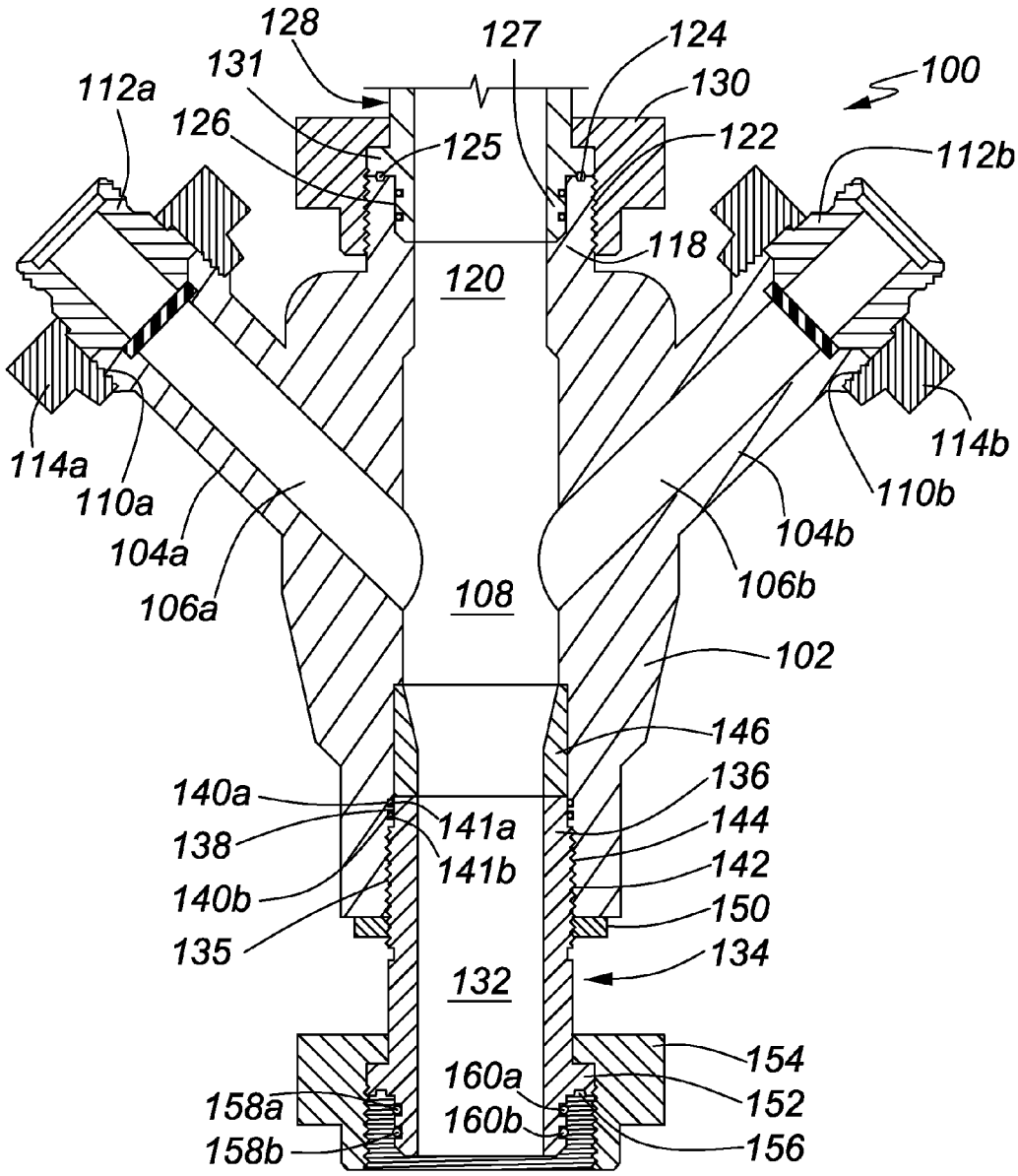
FIG. 1 is a schematic cross-sectional diagram of one embodiment of a multipart frac head in accordance with the invention.

FIG. 1 is a schematic cross-sectional diagram of one embodiment of a multipart frac head 100 in accordance with the invention. The multipart frac head 100 has a frac head body 102 and a plurality of inlet ports, two of which (104*a*, 104*b*) are shown. Frac heads are normally equipped with 2-5 inlet ports. In this embodiment the inlet ports 104*a*, 104*b* are welded to the frac head body 102 using methods well known in the art. Each inlet port 104*a*, 104*b* includes a respective central bore 106*a*, 106*b* in fluid communication with a mixing chamber 108 of the frac head body 102. A top end 110*a*, 110*b* of each inlet port 104*a*, 104*b* terminates in a pin thread to which a frac iron adapter 112*a*, 112*b* is connected by a wing nut 114*a*, 114*b*, also in a manner well known in the art.

The frac head body 102 has a top end of 118 with a central passage 120 in fluid communication with the mixing chamber 108. In this embodiment, the top end 118 terminates in a threaded union connector described in Applicant's U.S. Pat. No. 7,125,055 entitled Metal Ring Gasket for a Threaded Union, which issued on Oct. 24, 2006, the specification of which is incorporated herein by reference in its entirety. The threaded union connector includes a pin thread 122, a metal ring gasket groove 124 that receives a metal ring gasket 125, and a socket 126 that receives a pin end 127 of a complementary threaded union connector of equipment 128 connected to the multipart frac head 100. The equipment 128 is typically a high-pressure valve, but may be any other well completion, re-completion or workover equipment. The pin thread 122 is engaged by a box thread of a wing nut 130 supported by an external shoulder 131 of the complementary threaded union connector of the equipment 128.

A bottom of the mixing chamber 108 has a funnel-shaped section that tapers inwardly to a central passage 132 of a bottom leg 134 received in a bottom leg socket 135 in the frac head body 102. The bottom leg 134 has a top end 136 with a smooth outer diameter that enters a seal bore 138 in the bottom leg socket 135. Two O-ring grooves 140*a*, 140*b* accept O-rings 141*a*, 141*b* that provide a high-pressure fluid seal around the top end 136 of the bottom leg 134. An elongated pin thread 142 on the bottom leg 134 engages a box thread 144 in the bottom leg socket 135. In this embodiment, the tapered bottom end of the mixing chamber 108 is lined with a wear-resistant insert 146. Due to its position at the bottom of the mixing chamber 108, the wear-resistant insert 146 protects the frac head body 102 from most of the abrasive turbulence caused by the confluence of frac fluid streams pumped into the mixing chamber 108 through the inlet ports 104*a*, 104*b*. The wear-resistant insert 146 is held in place by the top end 136 of the bottom leg 134. A lock nut 150 engages the elongated pin thread 142. After the bottom leg 134 is securely secured in the bottom leg socket 135, the lock nut 150 is turned up tight against a bottom end of the frac head body 102 to lock the bottom leg 134 in place and ensure that it will not back out of the bottom leg socket 135.

A bottom end of the bottom leg 134 terminates in a threaded union connector described in Applicant's above-referenced United States Patent. The bottom end includes an external shoulder 152 that supports a wing nut 154. A metal ring gasket groove 156 accepts a metal ring gasket (not shown) for the threaded union, and two of O-ring grooves 158*a*, 158*b* accept O-rings 160*a*, 160*b* for providing primary fluid seals for the metal ring gasket.

As is well known to those skilled in the art, the bottom of the mixing chamber and the bottom leg of a frac head are normally the parts most likely to wash. Consequently, the multipart frac head 100 is easily maintained in the field by replacing the wear-resistant insert 146 and/or the bottom leg 134 with new or refurbished replacement parts.

Figure 2:
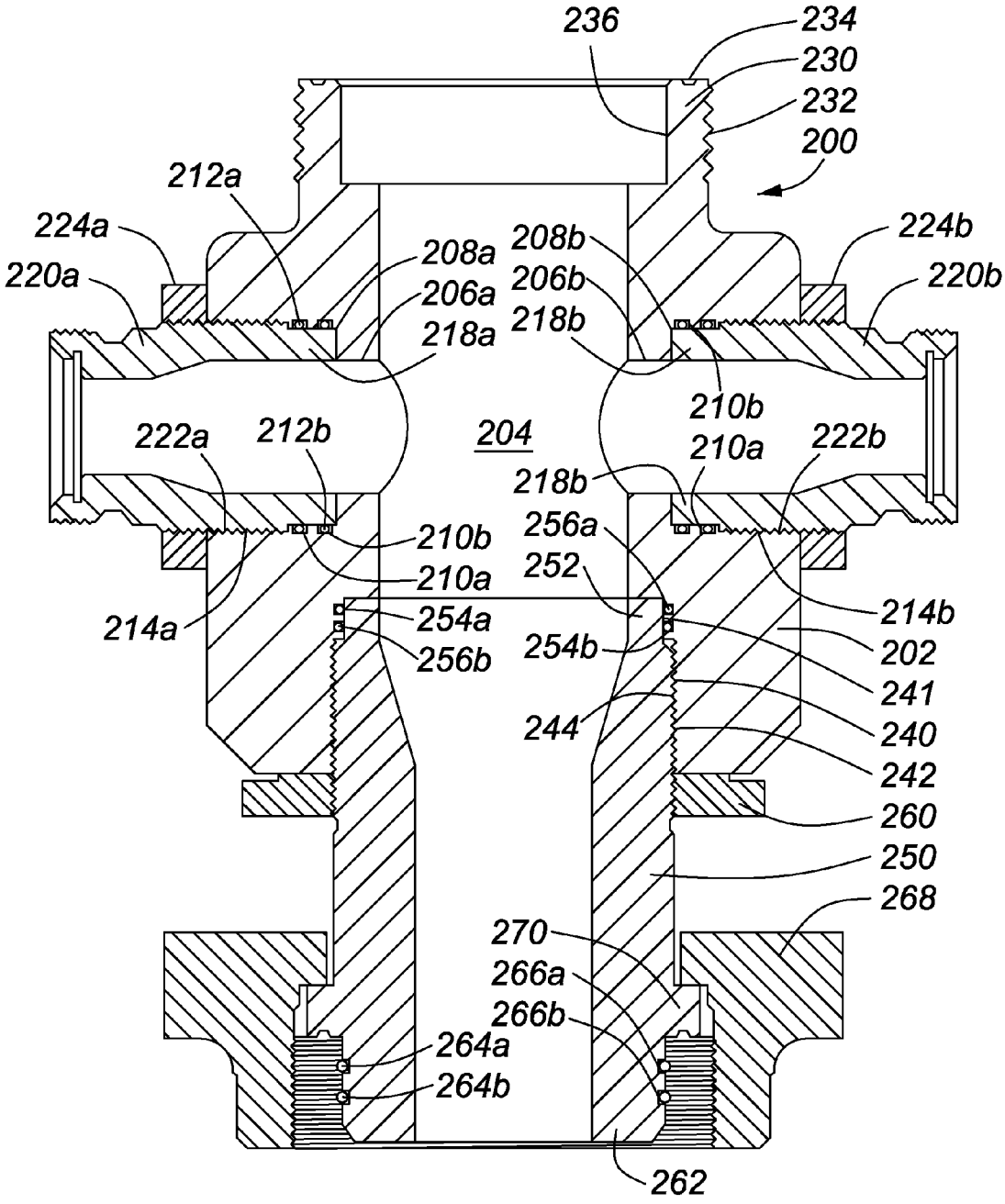
FIG. 2 is a schematic cross-sectional diagram of another embodiment of the multipart frac head in accordance with the invention.

FIG. 2 is a schematic cross-sectional view of another embodiment of the multipart frac head in accordance with the invention. The multipart frac head 200 is constructed and assembled without welding. The multipart frac head 200 includes a frac head body 202 with a central passage that having a mixing chamber 204. A plurality of side entries, only two (206*a*, 206*b*) of which are shown, are machined into a cylindrical sidewall of the frac head body 202 at right angles with respect to the mixing chamber 204. Each side entry includes a seal bore 208*a*, 208*b*. Each seal bore has two O-ring grooves 210*a*, 210*b* that accept O-rings 212*a*, 212*b*, which seal against a respective inner end 218*a*, 218*b* of the respective inlet ports 220*a*, 220*b*. Box threads 214*a*, 214*b* machined in the respective side entries 206*a*, 206*b* cooperate with elongated pin threads 222*a*, 222*b* to retain and the respective inlet ports 220*a*, 220*b* in the respective side entries 206*a*, 206*b*. Lock nuts 224*a*, 224*b* which respectively engage outer ends of the respective elongated pin threads 222*a*, 222*b*, lock the inlet ports 220*a*, 220*b* in the side entries 206*a*, 206*b*.

A threaded union connector 230 is machined at a top of the frac head body 202. The threaded union connector 230 includes a peripheral pin thread 232; a metal ring gasket groove 234; and, a socket 236 that receives a pin end of a complementary threaded union connector of well stimulation equipment or flow control equipment mounted to the frac head (not shown). A bottom leg socket 240 is machined into the bottom end of the frac head body 202 concentric with the mixing chamber 204. The bottom leg socket 240 includes a seal bore 241 located inwardly of a box thread 242. The seal bore includes two O-ring grooves 254*a*, 254*b* which respectively accept O-rings 256*a*, 256*b*. A top end 252 of the bottom leg 250 is received in the seal bore 241 and cooperates with the O-rings 256*a*, 256*b* to provide a high-pressure fluid seal between the bottom leg 250 and the bottom leg socket 240. An elongated pin thread 244 on the bottom leg 250 engages the box thread 242 to lock the bottom leg 250 in the bottom leg socket 240. A lock nut 260 engages an outer end of the pin thread 244 and is tightened against a bottom of the frac head body 202 to prevent the bottom leg 250 from backing out of the bottom leg socket 240. The bottom leg 250 terminates in a threaded union connector of the type described above with reference to FIG. 1. The threaded union connector includes a pin end 262 with two O-rings 264*a*, 264*b* received in O-ring grooves 266*a*, 266*b*. A wing nut 268 is supported by an annular shoulder 270 on a lower periphery of the bottom leg 250.

As will be understood by those skilled in the art, any one of the inlet ports 220*a*, 220*b* and the bottom leg 250 can be replaced in the field. Consequently, the multipart frac head 200 is less expensive to maintain because it can be refurbished in the field by field hands using machined replacement parts. It is also less expensive to build because its constructed using only machined parts, so no preheating or skilled labor for welding are required.

Figure 3:
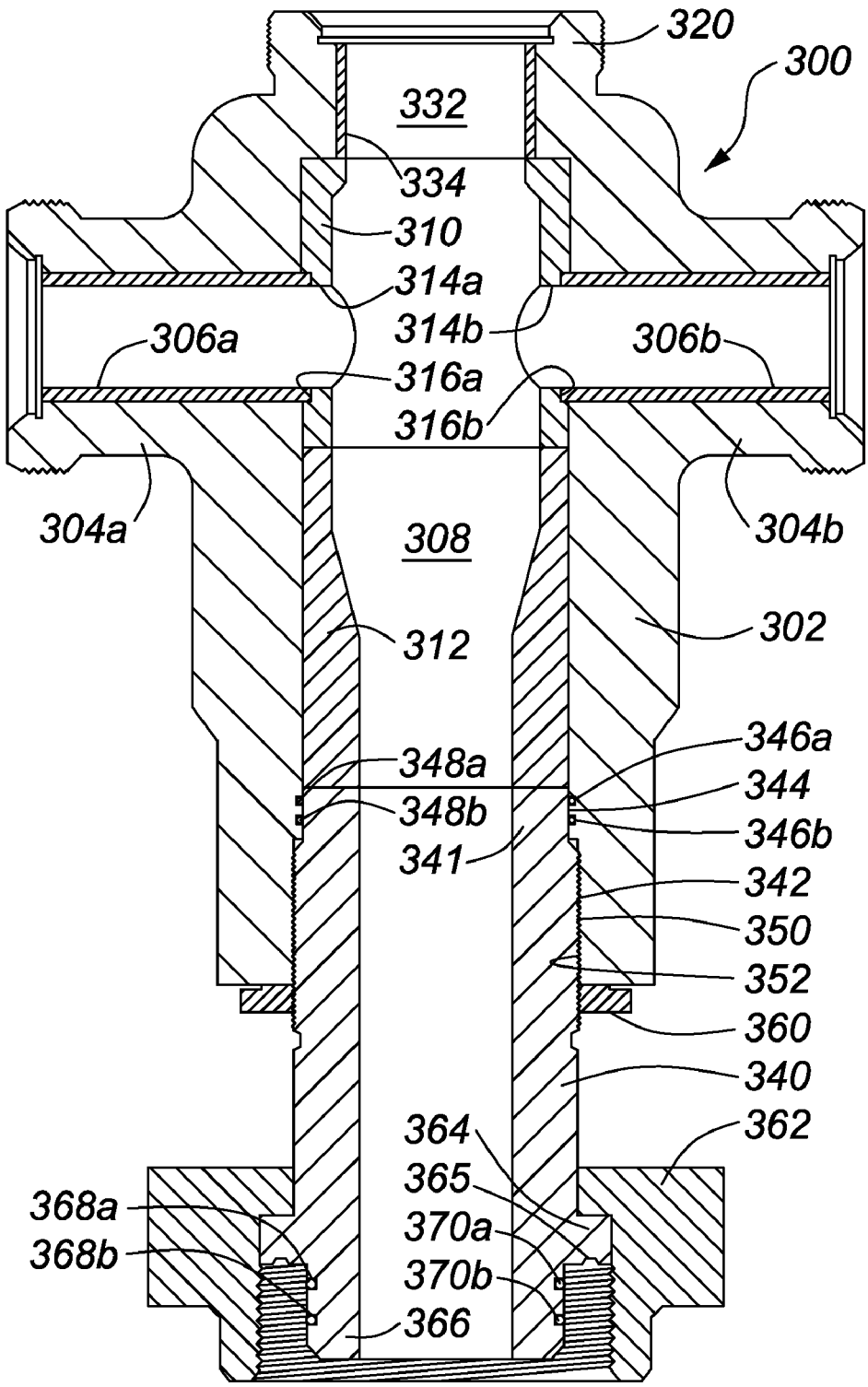
FIG. 3 is a schematic cross-sectional diagram of yet another embodiment of the multipart frac head in accordance with the invention.

FIG. 3 is a schematic cross-sectional view of another embodiment of the multipart frac head in accordance with the invention. The multipart frac head 300 closely resembles the multipart frac head 200 described above with reference to FIG. 2, except that the multipart frac head 300 has welded-in inlet ports 304*a*, 304*b*, which are well known in the art. A central bore of each inlet port 304*a*, 304*b* receives a respective wear sleeve 306*a*, 306*b*, as described in Applicant's above-referenced published patent application. A mixing chamber 308 of the frac head body 302 is lined by a first wear sleeve 310 and a second wear sleeve 312. The first wear sleeve 310 includes a plurality of side entries 314*a*, 314*b* with sockets 316*a*, 316*b* machined in an outer periphery of the wear sleeve 310 which respectively receive inner ends of the wear sleeves 306*a*, 306*b*. A top end of the frac head body 302 is machined to include a frac iron adapter 320 having a central passage 332 lined by a wear sleeve 334.

A bottom leg 340 of the frac head 300 is received in a bottom leg socket 342, which includes a seal bore 344 that receives a top end 341 of the bottom leg 340. O-ring grooves 346*a*, 346*b* receive O-rings 348*a*, 348*b* to provide a fluid tight seal around the top end 341 of the bottom leg 340. A box thread 350 in the bottom leg socket 342 is engaged by an elongated pin thread 352 on the bottom leg 340 to secure the bottom leg 340 in the bottom leg socket 350. A lock nut 360 also engages and outer end of the elongated the pin thread 352 to lock a bottom leg 340 in the bottom leg socket 342, as described above. A lower end of the bottom leg 340 is provided with a threaded union connector, which includes a wing nut 362 rotateably supported by a peripheral shoulder 364. A bottom of the peripheral shoulder 364 includes a metal seal ring groove 365. A pin end 366 of the threaded union connector includes O-ring grooves 368*a*, 368*b*, which accept O-rings 370*a*, 370*b*.

Figure 4:
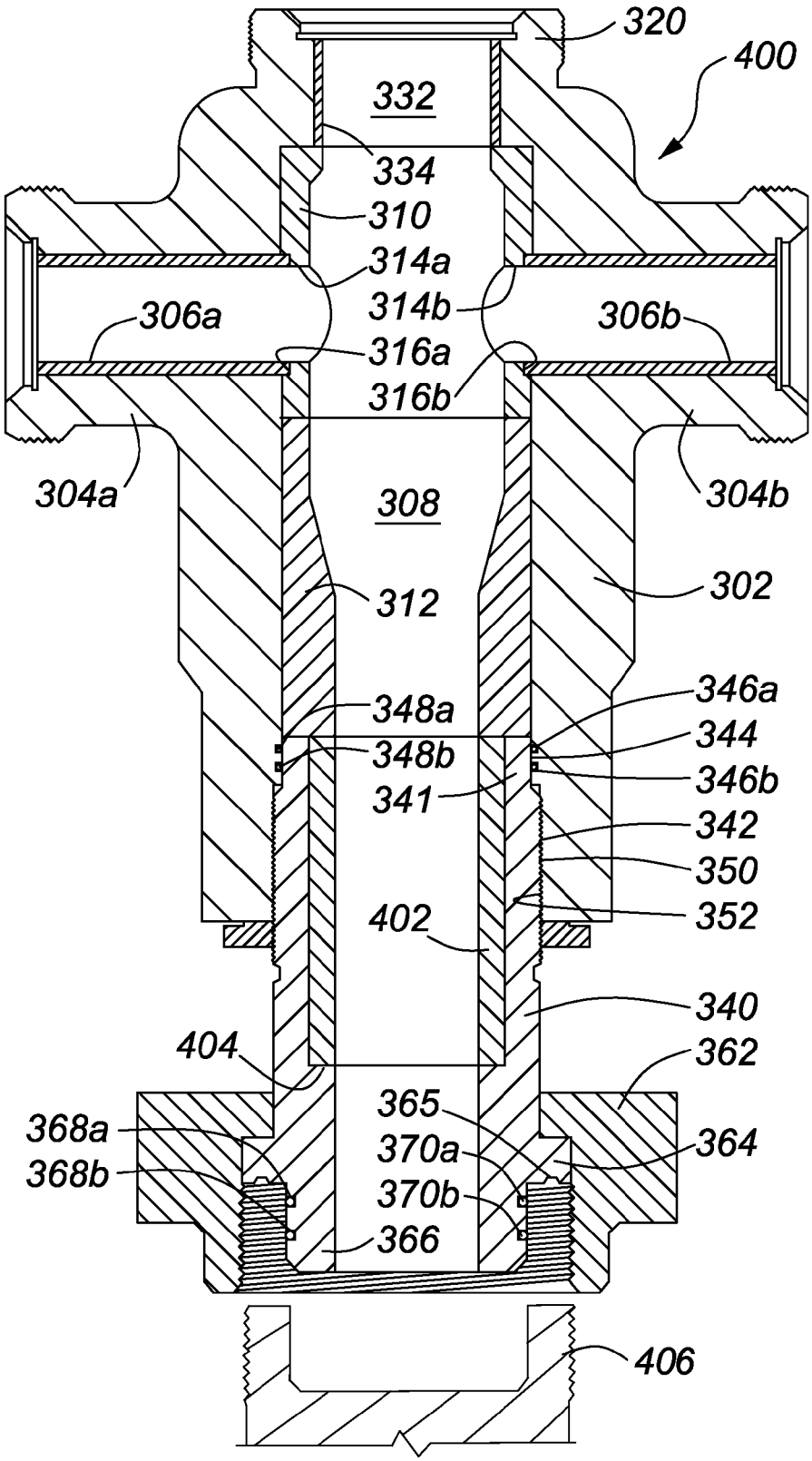
FIG. 4 is a schematic cross-sectional diagram of a further embodiment of the multipart frac head in accordance with the invention.

FIG. 4 is a cross-sectional schematic diagram of yet another embodiment of the multipart frac head in accordance with the invention. A multipart frac head of 400 is identical to the multipart frac head 300 described above with reference to FIG. 3, with an exception that the bottom leg 340 includes a wear sleeve 402 received in a wear sleeve socket 404 to further improve an abrasion resistance of the bottom leg 340. As understood by those skilled in the art, the multipart frac heads shown in FIGS. 1-4 are connected to a wellhead or wellhead isolation equipment, a top end of which is shown schematically at 406.

Figure 5:
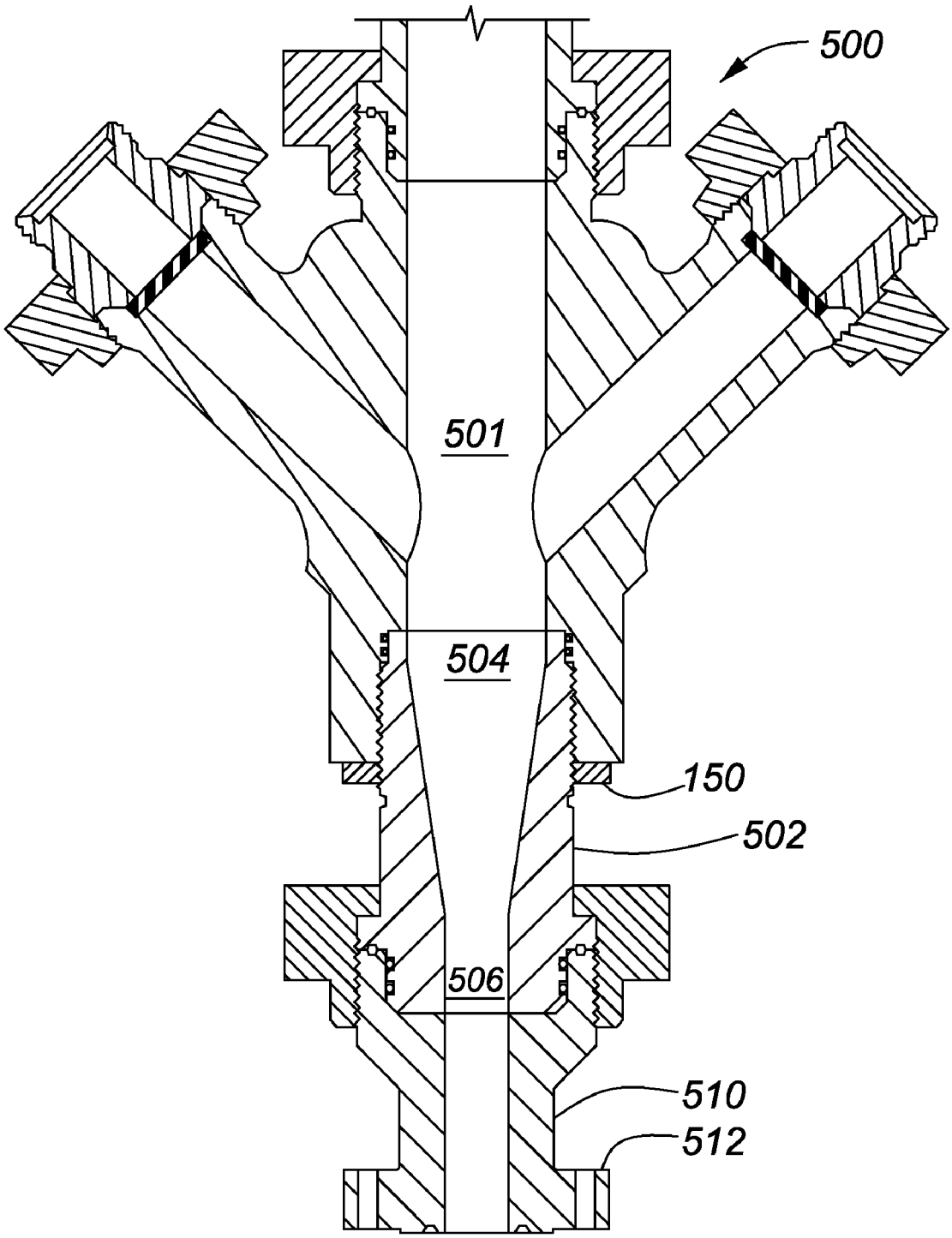
FIG. 5 is a schematic cross-sectional diagram of the multipart frac head similar to the frac head shown in FIG. 1, with a bottom leg that includes a funnel-shaped section to reduce an internal diameter of an outlet of the frac head to permit the multipart frac head to be used with wellhead isolation equipment with a through-bore of a size corresponding to the reduced internal diameter.

FIG. 5 is a schematic cross-sectional diagram of a multipart frac head 500, which is similar to the multipart frac had 100 described above with reference to FIG. 1. The multipart frac head 500 has a bottom leg 502 that is funnel-shaped to reduce an internal diameter (ID) of the frac head outlet 506. This permits the multipart frac head to be used with wellhead isolation equipment with a through-bore of an ID the size of the frac head outlet 506. A central passage 504 at a top end of the bottom leg 502 forms a bottom of a mixing chamber 501. The central passage 504 tapers to the frac head outlet 506, which has an ID of, for example, 2¾", 3½", or 4½". By stocking bottom legs 502 with outlets 506 having different IDs, the bottom leg 502 can be changed as required to match an ID of the wellhead or wellhead isolation equipment to which the frac head 500 is mounted. The threaded union connector on the bottom end of the bottom leg 502 may be connected to a complementary threaded union connector on the top end of a flanged adapter 510 with a bottom flange 512 for mounting the frac head 500 to flanged wellhead or wellhead isolation equipment.

Figure 6:
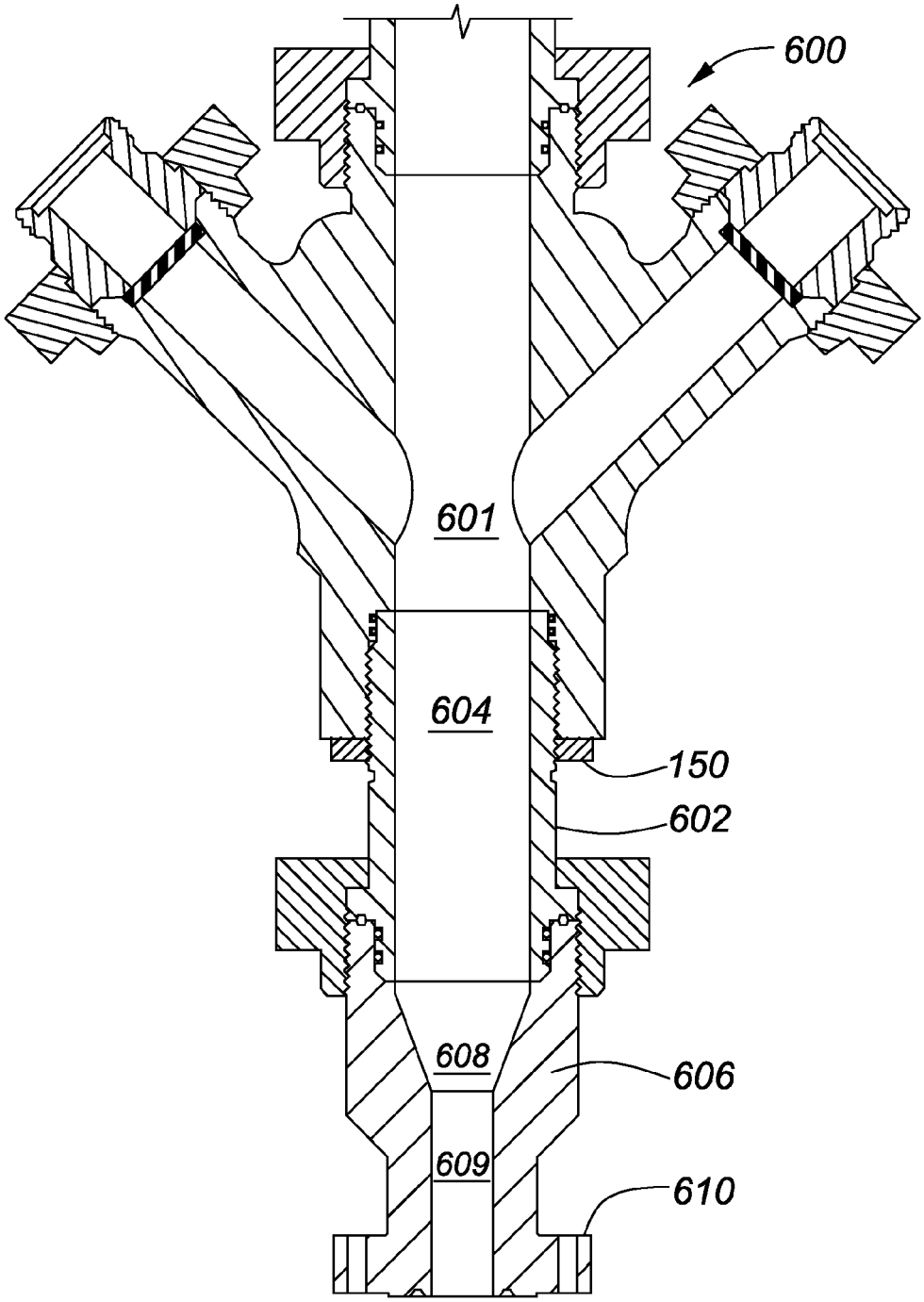
FIG. 6 is a schematic cross-sectional diagram of the multipart frac head similar to the frac head shown in FIG. 1, with a flanged adapter that includes a funnel-shaped section to reduce an internal diameter of an output of the frac head to permit the multipart frac head to be used with wellhead isolation equipment having a through-bore of a size corresponding to the reduced internal diameter.

FIG. 6 is a schematic cross-sectional diagram of a multipart frac head 600, which is similar to the multipart frac had 100 described above with reference to FIG. 1. The multipart frac head 600 has a bottom leg 602 that has a central passage 604 of a same diameter as a mixing chamber 601 of the frac head 600. A flanged adapter 606 connected to a bottom end of the bottom leg 602 has a through bore 608 that is funnel-shaped to reduce an ID of a flanged adapter outlet 609. This permits the multipart frac head to be used with wellhead isolation equipment with a through-bore of an ID corresponding to the ID of the flanged adapter outlet 609. The through bore 608 at the top end of the flanged adapter 606 forms a bottom of an elongated mixing chamber 601, 604. The through bore 608 tapers to the outlet 609 of a smaller ID, for example 2¾", 3½", or 4½". By stocking flanged adapters 602 with outlets 609 having different IDs, the flanged adapters 602 can be changed as required to match an ID of the wellhead or wellhead isolation equipment to which the frac head 600 is mounted. The flanged adapter 606 has a bottom flange 610 for mounting the frac head 500 to flanged wellhead or wellhead isolation equipment.

Figure 7:
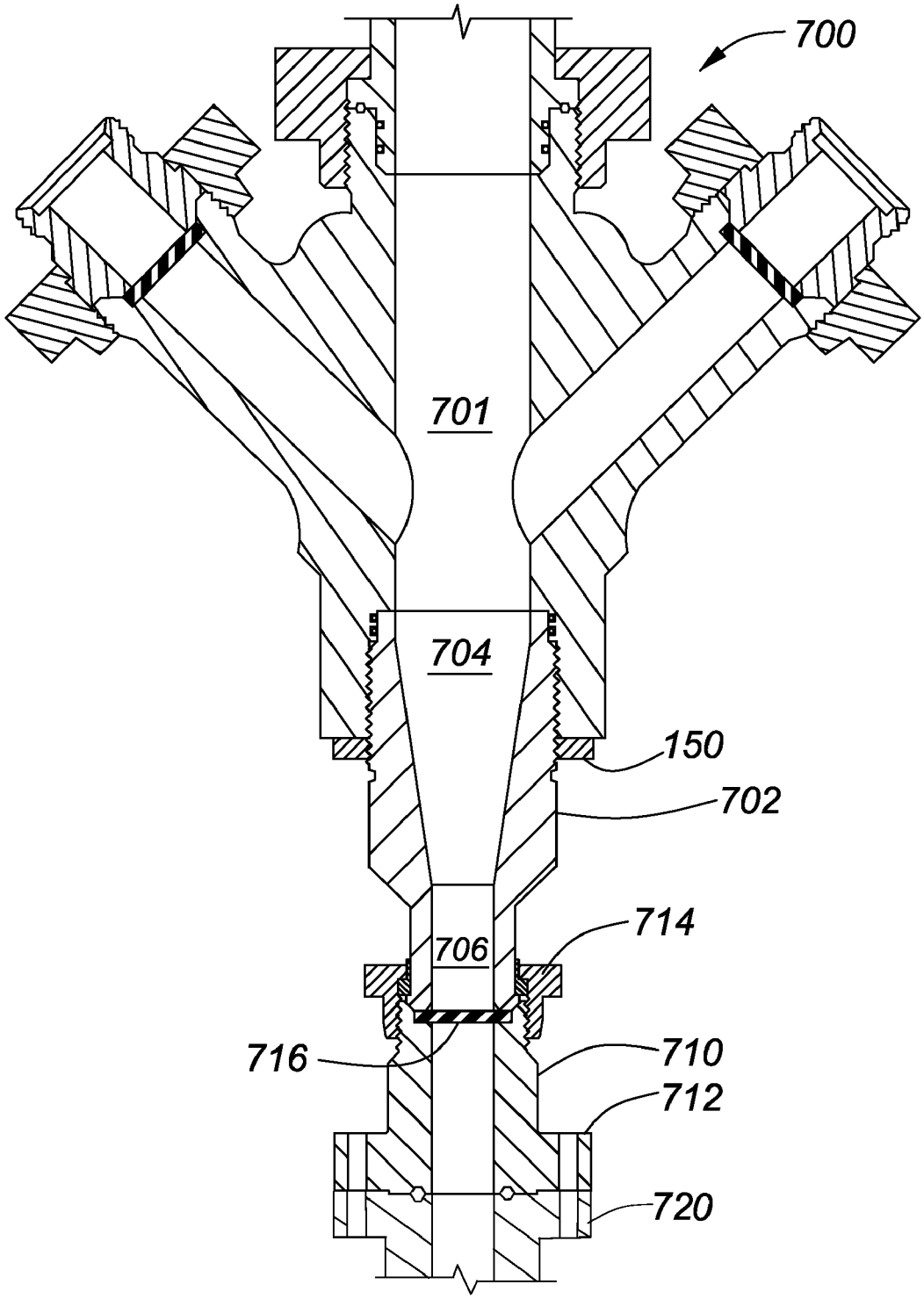
FIG. 7 is a schematic cross-sectional diagram of the multipart frac head similar to the frac head shown in FIG. 5, with a flanged adapter that includes the funnel-shaped section, and a bottom leg with a segmented wing nut.

FIG. 7 is a schematic cross-sectional diagram of a multipart frac head 700, which is similar to the multipart frac head 500 described above with reference to FIG. 5. The multipart frac head 700 has a bottom leg 702 with a central passage 704 that is funnel-shaped to reduce an internal diameter (ID) of a frac head outlet 706. This permits the multipart frac head 700 to be used with wellhead isolation equipment having a through-bore with an ID corresponding to the ID of the frac head outlet 706. The central passage 704 at a top end of the bottom leg 702 forms a bottom of a mixing chamber 701 of the frac head 700. The central passage 704 tapers to the frac head outlet 706, which has a smaller ID, for example 2¾", 3½", or 4½", as described above. By stocking bottom legs 702 with outlets 706 having different IDs, the bottom leg 702 can be changed as required to match an ID of the wellhead or wellhead isolation equipment to which the frac head 700 is mounted. The threaded union connector on the bottom end of the bottom leg 702 may be connected to a complementary threaded union connector on the top end of a flanged adapter 710 with a bottom flange 712 for mounting the frac head 700 to flanged wellhead or wellhead isolation equipment. As understood by those skilled in the art, the multipart frac heads shown in FIGS. 5-7 are flanged to permit a bolted connection to a flanged wellhead or flanged wellhead isolation equipment, a top end of which is shown schematically at 720.

In this embodiment, the bottom leg 702 is equipped with a segmented wing nut 714, as described in Applicants published patent application 2006/0090891A1 referenced above. Each of the bottom legs for the frac heads 100-600 described above have the same outer diameter from the top end to the external shoulder that supports the wing nut for the threaded union connector. Consequently, a wing nut machined from a single piece of steel can be used for each of those bottom legs. Because of the shape of the bottom leg 702, the segmented wing nut 714 is used instead, and a high-pressure elastomeric seal 716 well known in the art provides a fluid seal between the adapter flange 710 and the bottom leg 702.

While various embodiments of the frac heads in accordance with the invention have been described, it should be understood that those embodiments described above are exemplary only.

The scope of the invention is therefore intended to be limited solely by the scope of the appended claims.

We claim:

1. A multipart frac head, comprising:

a frac head body having a plurality of inlet ports threadedly secured in respective side entries in the frac head body, and a bottom leg socket in a bottom end of the frac head body; and a bottom leg removably secured in the bottom leg socket, the bottom leg comprising an inner end having an elongated pin thread that cooperates with a box thread in the bottom leg socket to secure the bottom leg in the bottom leg socket, the elongated pin thread extending beyond the bottom leg socket when the bottom leg is secured in the bottom leg socket and is engaged by a box thread of a lock nut that is tightened against the bottom end of the frac head body to lock the bottom leg in the bottom leg socket, and an outer end that includes an external shoulder with an upper side that supports a threaded union nut and an underside with a metal ring gasket groove.

2. The multipart frac head as claimed in claim 1 wherein the side entries comprise a box thread and a side entry seal bore.

3. The multipart frac head as claimed in claim 2 wherein the respective inlet ports comprise an elongated pin thread that cooperates with the respective box threads in the respective side entries, and an outer end of each elongated pin thread receives a lock nut that is tightened against the frac head body to lock the respective inlet ports in the respective side entries.

4. The multipart frac head as claimed in claim 3 wherein the respective side entry seal bores comprise a first and second O-ring groove that respectively receive O-rings for sealing against an inner end of the respective inlet ports.

5. The multipart frac head as claimed in claim 1 wherein an inner end of the bottom leg socket comprises a bottom leg seal bore and the bottom leg seal bore comprises first and second O-ring grooves that respectively receive O-rings that seal against an inner end of the bottom leg.

6. The multipart frac head as claimed in claim 1 wherein a central passage of the bottom leg has a funnel-shaped section.

7. The multipart frac head as claimed in claim 6 wherein the funnel-shaped section reduces an internal diameter of an outlet of the frac head to permit the frac head to be mounted to a wellhead or wellhead isolation equipment having a smaller internal diameter than an outlet of a mixing chamber of the frac head body.

8. A multipart frac head, comprising:

a frac head body having a plurality of inlet ports threadedly secured in respective side entries machined in a sidewall of the frac head body, and a bottom leg socket in a bottom end of the frac head body that comprises a box thread and a seal bore located inwardly of the box thread;

a bottom leg removably secured in the bottom leg socket, the bottom leg comprising an inner end received in the seal bore and an elongated pin thread that cooperates with the box thread to secure the bottom leg in the bottom leg socket; and a lock nut threadedly secured to an outer end of the elongated pin thread, the lock nut being tightened against a bottom end of the frac head body to lock the bottom leg in the bottom leg socket.

9. The multipart frac head as claimed in claim 8 wherein the plurality of inlet ports comprise an elongated pin thread that secures the respective inlet ports to a box thread in the respective side entries, each inlet port further comprising an inner end that cooperates with a seal bore of the side entry in which the inlet port is received to provide a high pressure fluid seal between the inlet port and the frac head body.

10. The multipart frac head as claimed in claim 9 wherein the seal bore of the side entry comprises first and second O-ring grooves that respectively receive O-rings that seal against the inner end of the bottom leg.

11. The multipart frac head as claimed in claim 8 wherein a central passage of the bottom leg has a funnel-shaped section.

12. The multipart frac head as claimed in claim 11 wherein the funnel-shaped section reduces an internal diameter of an outlet of the frac head to permit the frac head to be mounted to a wellhead or wellhead isolation equipment having a smaller internal diameter than an outlet of a mixing chamber of the frac head body.

13. A multipart frac head, comprising:

a frac head body having a plurality of threaded side entries retained in respective inlet ports, and a bottom leg socket that comprises a box thread and a seal bore located inwardly of the box thread;

a bottom leg threadedly secured in the bottom leg socket, the bottom leg comprising an inner end received in the seal bore, the inner end cooperating with high-pressure seals in the seal bore to provide a high-pressure fluid seal around the bottom leg, and an elongated pin thread that cooperates with the box thread to secure the bottom leg in the bottom leg socket;

a lock nut threadedly secured to an outer end of the elongated pin thread, the lock nut being tightened against a bottom end of the frac head body to lock the bottom leg in the bottom leg socket.

14. The multipart frac head as claimed in claim 13 wherein the plurality of inlet ports comprise an elongated pin thread that secures the respective inlet ports to a box thread in the respective side entries, each inlet port further comprising an inner end that cooperates with a seal bore of the side entry in which the inlet port is received to provide a high pressure fluid seal between the inlet port and the frac head body.

* * * * *